United States Patent [19]

Sanderow et al.

[11] 4,050,933

[45] * Sept. 27, 1977

[54] IMPERVIOUS METAL OBJECT AND METHOD OF MAKING THE SAME

[75] Inventors: Howard I. Sanderow, Cherry Hill, N.J.; Kenneth M. Merz, Malvern, Pa.

[73] Assignee: Stanadyne, Inc., Hartford, Conn.

[ * ] Notice: The portion of the term of this patent subsequent to Oct. 1, 1991, has been disclaimed.

[21] Appl. No.: 485,450

[22] Filed: July 3, 1974

Related U.S. Application Data

[63] Continuation of Ser. No. 334,242, Feb. 21, 1973, Pat. No. 3,838,982.

[51] Int. Cl.[2] ..... C22C 1/04

[52] U.S. Cl. ..... 75/246; 75/212; 75/226; 428/554

[58] Field of Search ..... 75/212, 226; 29/182

[56] References Cited

U.S. PATENT DOCUMENTS

| | | | |
|---|---|---|---|
| 1,986,197 | 1/1935 | Harshaw | 75/212 |
| 2,610,118 | 9/1952 | Drapeau | 75/212 |
| 3,838,982 | 10/1974 | Sanderow et al. | 75/212 X |

FOREIGN PATENT DOCUMENTS

| | | | |
|---|---|---|---|
| 779,969 | 7/1957 | United Kingdom | 75/212 |

*Primary Examiner*—Richard E. Schafer
*Attorney, Agent, or Firm*—Jacob Trachtman

[57] ABSTRACT

A metallic object formed of metal particles compressed together to form a rigid object. Each of the metal particles is coated with a metal having a melting temperature lower than that of the metal of the particles. The coating metal fills the voids between the particles so that the object is impervious to fluids.

14 Claims, 1 Drawing Figure

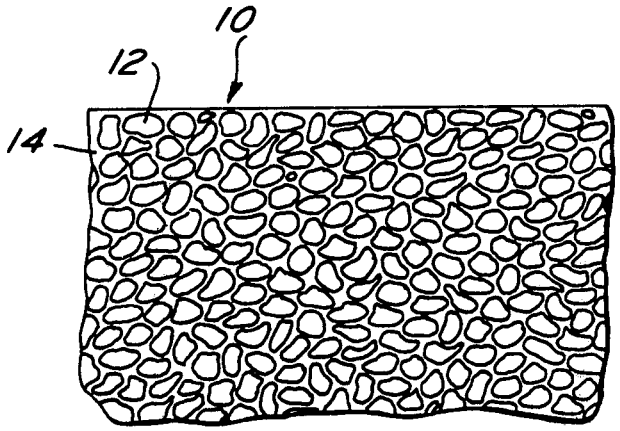
10
12
14

IMPERVIOUS METAL OBJECT AND METHOD OF MAKING THE SAME

This is a continuation application of our copending application Ser. No. 334,242 filed Feb. 21, 1973, now U.S. Pat. No. 3,838,982 entitled Impervious Metal Object and Method of Making the Same.

The present invention relates to a metallic object formed by powder metallurgy, and more particularly to such a metallic object which is impervious to fluid and a method of making such metallic objects.

A method of making metallic objects, known as powdered metallurgy, generally includes the steps of compressing together and sintering under the application of heat, particles of the metal to bond the particles together as a rigid body. The metal bodies made by this technique generally have a density of 80% to 90% of the theoretical density so as to include interconnected pores or voids. This pore network permits the passage of fluids through the body so that such bodies cannot be used to make parts where imperviousness is required, such as parts for pumps, fluid transmission systems, etc.

Various techniques have been developed to form an impervious metallic body by powdered metallurgy. One technique is to raise the finished product density to achieve non-interconnected porosity. However, this technique requires large presses and high temperature sintering treatments. Also, it entails stringent process controls and numerous quality control and final part inspection operations. All of these requirements makes this technique very costly to carry out.

Another technique which has been developed is a controlled oxidation of the compressed metal body, generally a steam oxidation process, to fill surface voids with oxides of the metal. This technique has been found to be difficult to control as to the type of oxide formed, depth of the oxide layer, surface hardness and surface quality. Also, since it requires a secondary operation after the standard powdered metallurgy processing, the overall cost of making the body is increased. In addition, the bodies made by this technique are lower in density in order that a substantial oxide layer can be produced in the surface pores. This leads to a lower strength of the bodies as compared to standard bodies. Similarly, the bodies cannot be hardened by carburizing treatment, since carbon would react with the surface layer, reducing the oxide back to the metal and opening the surface pores. Still another disadvantage of this technique is that the impervious layer is localized at the surface of the body. This precludes any surface finishing or metal working operations that would break the surface oxide layer.

A third technique which has been developed is to impregnate the pores of the body with a plastic or a liquid metal which is not soluble with the metal of the particles which form the body. However, this technique also has the disadvantage of extra expense because of the additional processing required. Also, this technique has been found to be difficult to control and maintain long term part-to-part uniformity. When a plastic is used to impregnate the pores of the body, no additional strengthening is afforded by the plastic, leaving the final product with a lower tensile strength than can be achieved without impregnation. When a metal is used to impregnate the pores, relatively large contents of the metal are required to achieve imperviousness.

It is therefore an object of the present invention to provide a novel impervious metal body made by powdered metallurgy.

It is another object of the present invention to provide an impervious metal body made by powdered metallurgy which can be surface hardened without loosing imperviousness.

It is a further object of the present invention to provide a novel method of making an impervious metal body by powdered metallurgy.

It is still a further object of the present invention to provide a method of making a body by powdered metallurgy which provides imperviousness during the compression-sintering operation.

Other objects will appear hereinafter.

These objects are achieved by using metal particles which are coated with a thin film of a metal having a melting temperature lower than that of the metal of the particles. After the coated particles are compressed to form the body, they are heated to the melting temperature of the coating metal. The melted coating metal flows to fill the voids between the particles. When the body is cooled, there is provided a body of the particles bonded together with the spaces between the particles being filled with the coating metal to provide an impervious body.

The drawing is an enlarged sectional view of a part of a metal body of the present invention.

The metal body of the present invention, generally designated as 10, comprises particles 12 of a desired metal, such as iron. Each of the particles 12 is completely surrounded by a thin layer 14 of a metal, such as copper, having a melting temperature lower than the melting temperature of the metal of the particles 12. When the particles 12 are compressed together and sintered, the iron particles bond together by solid state diffusion while the layer 14 is molten and fills the voids between the particles 12. The metal layer 14 filling most voids between the particles 12, renders the body 10 impervious to the flow of fluid through the body 10 by eliminating interconnected voids. There must be at least 12% by weight of the metal layer 14. Although suitable metal bodies 10 can be obtained with the metal layer 14 being present in the amount of 12 to 16% by weight, up to 30% by weight of the metal layer 14 can also be used.

To make the metal body 10, the individual metal particles 12 are first coated with the metal layer 14. This is preferably done by a chemical displacement process. For example, a 12% copper on iron particle can be made by starting with −100 mesh iron particles and an aqueous plating solution of $CuSO_4 \cdot 5H_2O$. The amount of the copper sulfate solution is calculated to provide 12% copper in the bath. The solution is maintained at room temperature and a pH of 3 with $H_2SO_4$additions. The iron powder used is introduced into the solution, rapidly stirred for a period of 3 to 10 minutes, and removed from the solution. The coated powder is then washed in slightly acidified water and vacuum dried.

The coated particles are then mixed together with graphite (0.5 to 1.0%) and a lubricant such as zinc stearate (0.75%). The graphite has been found to reduce the solubility of the copper in the iron. This leaves more of the copper to fill the pores or voids and make a more dense body. The lubricant helps in the compacting of the body. A charge of the coated particles is then compacted at a pressure of 35–50 tons per square inch and sintered for about 30 minutes at 2050° F in dissociated ammonia. The compacting presses the particles close together. The sintering causes the metal layer 14 to melt. The liquid metal flows and fills the voids between the particles. When the body cools, the metal solidifies and forms the impervious body 10.

Since the body is made entirely of metal and does not contain interconnecting voids extending therethrough, it can be surface hardened by carburization without destroying the imperviousness of the body. Also, the body can be surface ground, punched, reamed or otherwise machined without affecting the imperviousness of the body. By making the body of the coated metal particles, the impervious body can be made by a standard compression-sintering operation so as to maintain a low cost for making the body.

What is claimed is:

1. A method of making an impervious metal body comprising the steps of completely coating iron powder particles with a layer of copper which is about 12% to about 30% by weight of the body, compressing said coated particles together, and heating the compressed particles to a temperature at which the copper layer melts and the melted copper flows and fills the voids between the particles.

2. The method in accordance with claim 1 in which the compressed coated particles are heated at the same time that the particles are compressed together.

3. The method in accordance with claim 1 in which the iron particles are coated with the copper layer by chemical displacement.

4. The method in accordance with claim 3 in which the iron particles are coated by immersing in an aqueous solution of copper sulphate.

5. The method in accordance with claim 4 in which graphite is mixed with the coated particles prior to compressing the particles together.

6. The method in accordance with claim 5 in which the carbon is present in the amount of 0.5% to 1.0%.

7. An impervious metal body produced by completely coating iron powder particles with a layer of copper which is about 12% to about 30% by weight of the body, compressing the coated particles together, and heating the compressed particles to a temperature at which the copper layer melts and the melted copper flows and fills the voids between the particles.

8. The metal body in accordance with claim 7 in which the compressed coated particles are heated at the same time that the particles are compressed together.

9. The metal body in accordance with claim 7 in which the iron particles are coated with the copper layer by chemical displacement.

10. The metal body in accordance with claim 9 in which the iron particles are coated by immersing in an aqueous solution of copper sulphate.

11. The metal body in accordance with claim 10 in which graphite is mixed with the coated particles prior to compressing the particles together.

12. The metal body in accordance with claim 11 in which the carbon is present in the mix in the amount of 0.5% to 1.0%.

13. The method in accordance with claim 1 in which the iron powder particles are coated with a layer of copper which is between 12% and 16% by weight of the body.

14. The metal body in accordance with claim 7 in which the iron powder particles are coated with a layer of copper which is between 12% and 16% by weight of the body.

* * * * *